US006541911B1

(12) United States Patent
Tanabe et al.

(10) Patent No.: US 6,541,911 B1
(45) Date of Patent: Apr. 1, 2003

(54) MULTI-COLOR EMISSION DISPERSION TYPE ELECTROLUMINESCENCE LAMP

(75) Inventors: Koji Tanabe, Katano (JP); Yosuke Chikahisa, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/498,333

(22) Filed: Feb. 4, 2000

(30) Foreign Application Priority Data

Feb. 5, 1999 (JP) ..... 11-028232

(51) Int. Cl.[7] ..... H01J 1/88

(52) U.S. Cl. ..... 313/509; 313/503; 313/504; 362/84; 365/111

(58) Field of Search ..... 362/84; 365/110, 365/111; 348/800; 315/169.3; 313/483, 506, 498, 112, 509, 504, 503

(56) References Cited

U.S. PATENT DOCUMENTS

| | | | | | |
|---|---|---|---|---|---|
| 3,780,285 | A | * | 12/1973 | Appledorn et al. | 362/311 |
| 3,835,307 | A | * | 9/1974 | Johnston | 359/617 |
| 4,019,046 | A | * | 4/1977 | Reynolds | 362/351 |
| 4,089,045 | A | * | 5/1978 | Mars | 248/634 |
| 4,228,490 | A | * | 10/1980 | Thillays | 362/311 |
| 4,237,381 | A | * | 12/1980 | Schroeder | 250/462.1 |
| 4,261,027 | A | * | 4/1981 | Chapman et al. | 362/255 |
| 5,445,899 | A | | 8/1995 | Budzilek et al. | 428/690 |
| 5,705,285 | A | * | 1/1998 | Shi et al. | 428/690 |
| 5,757,026 | A | * | 5/1998 | Forrest et al. | 257/40 |
| 5,874,803 | A | * | 2/1999 | Garbuzov et al. | 313/506 |
| 6,037,865 | A | * | 3/2000 | Heinz et al. | 340/456 |

FOREIGN PATENT DOCUMENTS

| | | |
|---|---|---|
| EP | 0 973 358 A2 | 1/2000 |
| EP | 0 998 171 A2 | 5/2000 |

* cited by examiner

*Primary Examiner*—Sandra O'Shea
*Assistant Examiner*—Ismael Negron
(74) *Attorney, Agent, or Firm*—McDermott, Will & Emery

(57) ABSTRACT

An EL lamp for emitting light in multiple color which includes a first light-permeable electrode layer formed at the back side of a transparent substrate, a first luminous material layer containing a first luminous material, an intermediate light-permeable electrode layer, a second luminous material layer containing a second luminous material, a back electrode, and at least two elements of (i) a first color material contained in the first luminous material layer, (ii) a second color material contained in the second luminous material layer, and (iii) luminous color converting layer containing a third color material, disposed between the first luminous material layer and second luminous material layer, and a color coat layer containing a fourth color material, disposed at the front surface side of the transparent substrate. The color material closer to the back electrode of the at least two elements has the color of longer wavelength than the remoter color material.

29 Claims, 7 Drawing Sheets

MULTI-COLOR EMISSION DISPERSION TYPE ELECTROLUMINESCENCE LAMP

FIELD OF THE INVENTION

The present invention relates to an electro-luminescence (EL) lamp, and more particularly to a dispersion type EL lamp emitting light in multiple colors.

BACKGROUND OF THE INVENTION

An example of dichroic emission-dispersion type EL lamp is described by reference to FIG. 5 to FIG. 7 as a conventional multi-color emission-dispersion type EL lamp.

For the ease of understanding of constitution, the drawings are shown in magnified dimensions in the thickness direction.

FIG. 5 is an outline perspective view of a conventional dichroic emission-dispersion type EL lamp. FIG. 6 is a sectional view inverted in vertical and lateral direction along line 71–72 in FIG. 5. FIG. 7 is a sectional view inverted in vertical and lateral direction along line 81–82 in FIG. 5.

In FIG. 5, FIG. 6 and FIG. 7, the conventional dichroic emission-dispersion type EL lamp comprises a luminous plane 1 of the EL lamp, a plurality of external lead-out electrodes 2, 3 of light-permeable electrode layers composed inside, and an external lead-out electrode 4 of back electrode layer, and these external lead-out electrodes 2, 3 and external lead-out electrode 4 are provided at the side of the luminous plane 1.

In the magnified sectional views of FIG. 6 and FIG. 7, the conventional EL lamp comprises a transparent resin film 5 having a luminous plane 1, a first light-permeable electrode layer 6 printed and formed on other side of the transparent resin film 5, a first luminous material layer 7 printed and formed on the first light-permeable electrode layer 6, a second light-permeable electrode layer 8 printed and formed n the first luminous material layer 7, a luminous color converting layer 9 printed and formed on the second light-permeable electrode layer 8, a third light-permeable electrode layer 10 printed and formed on the luminous color converting layer 9, a second luminous material layer 11 printed and formed on the third light-permeable electrode layer 10, a back electrode 12 printed and formed on the second luminous material layer 11, and an insulating protective layer 13 for covering all layers.

The external lead-out electrodes 2, 3 are connected to the first light-permeable electrode layer 6, second light-permeable electrode layer 8 and third light-permeable electrode layer 10. The external lead-out electrode 4 is connected to the back electrode layer 12. The opposite side of the transparent resin film 5 forming the layers is the luminous plane 1.

The first light-permeable electrode layer 6 contains a transparent resin and a tin indium oxide powder dispersed in this transparent resin. The first luminous material layer 7 contains a highly dielectric resin such as cyano resin or fluororubber resin, and a granular fluorescent material dispersed in this highly dielectric resin. The fluorescent material has copper-doped zinc sulfide or the like. The second light-permeable electrode layer 8 contains a transparent resin and a tin indium oxide powder dispersed in this transparent resin. The luminous color converting layer 9 contains a transparent resin and a fluorescent pigment or fluorescent dye dispersed in this transparent resin. The fluorescent pigment or fluorescent dye has a luminous color of a longer wavelength than the luminous color of the first luminous material layer. The third light-permeable electrode layer 10 contains a transparent resin and a tin indium oxide powder dispersed in this transparent resin. The second luminous material layer 11 contains a highly dielectric resin and a granular fluorescent material dispersed in this highly dielectric resin. The fluorescent material has copper-doped zinc sulfide or the like. The insulating protective layer 12 contains a silver resin system paste or carbon resin system paste.

The thickness of the constituent layers in FIG. 5, FIG. 6 and FIG. 7 are magnified in view, and the actual thickness of each layer is about 1 $\mu$m to about 90 $\mu$m, except for the transparent resin film.

In such dichroic emission-dispersion type EL lamp, the fluorescent material for obtaining a practical emitting luminance and luminance life has cool colors such as blue and green. Therefore, the first luminous material layer 7 has a cool luminous color having a fluorescent material of blue or green luminous color dispersed in a synthetic resin. The second luminous material layer 11 also has cool luminous colors such as blue and green. The luminous color converting layer 9 has warm colors such as orange, red, pink and yellow of longer wavelength than cool luminous colors. The luminous color converting layer 9 has a function of converting the cool luminous color emitted from the second luminous material into a warm luminous color. In such constitution, when light is emitted from the first luminous material layer 7, the cool luminous color is released from the luminous plane. When the second luminous material layer 11 is illuminated, the luminous color converted into a warm color tone is released from the luminous plane. Thus, different luminous colors are obtained. To illuminate the first luminous material layer 7, a specified voltage is applied between the external lead-out electrode 2 and external lead-out electrode 3. To illuminate the second luminous material layer 11, a specified voltage is applied between the external lead-out electrode 3 and external lead-out electrode 4.

Each one of the first luminous material layer 7 and second luminous material layer 11 has two-layers in order to enhance the emitting luminance. A first layer of the two layers contains a transparent highly dielectric resin, and a fluorescent powder dispersed in the resin, and a second layer has a highly dielectric resin, and a highly dielectric fine powder such as barium titanate dispersed in the resin.

In such conventional multi-color emission-dispersion type EL lamp, however, when the first luminous material layer 7 is illuminated, the light emitted from the first luminous material layer 7 is reflected by the luminous color converting layer 9 disposed at the back side of the first luminous material layer 7, and this reflected light is released to the face side. Accordingly, the luminous color released to the face side of the first luminous material layer 7 is interfered by the reflected light. As a result, the original color of the first luminous material layer 7 is hardly released from the luminous plane.

For example, in the constitution in which the first luminous material layer 7 has a fluorescent material of blue luminous color, and the luminous color converting layer 9 has a fluorescent pigment of red luminous color, when the first luminous material layer 7 is illuminated, the blue luminous color released from the luminous plane 1 is interfered by the red reflected light of the luminous color converting layer 9, and a nearly white color is released from the luminous plane. It was thus difficult to obtain the original blue luminous color.

In particular, when such conventional multi-color emission-dispersion type EL lamp is used as the backlight of a translucent type liquid crystal display device, the translucent film of the translucent type liquid crystal display device reflects about 70% to about 90% of the light released from the multi-color emission-dispersion type EL lamp. Therefore, the reflected light is reflected to the luminous color converting layer in the multi-color emission-dispersion type EL lamp, and its reflected light is released to the liquid crystal display device side. Such reflection is repeated. As a result, the color interference is further promoted, and the problem becomes more manifest.

It is hence an object of the invention to present a multi-color emission-dispersion type EL lamp capable of suppressing color interference by reflected light due to other colored constituent materials, and obtaining a plurality of clear luminous colors from the luminous plane side.

SUMMARY OF THE INVENTION

The invention provides an EL lamp for emitting light in multiple colors from the front surface side of a transparent substrate, which comprises:

(a) the transparent substrate, (b) a first light-permeable electrode layer formed at the back side of the transparent substrate, (c) a first luminous material layer having a first luminous material, disposed at the back side of the first light-permeable electrode layer, (d) an intermediate light-permeable electrode layer disposed at the back side of the first luminous material layer, (e) a second luminous material layer having a second luminous material, disposed at the back side of the second light-permeable electrode layer, (f) a back electrode layer disposed at the back side of the second luminous material layer, and (g) at least two elements selected from the group consisting of:

(i) a first color material contained in the first luminous material layer, (ii) a second color material contained in the second luminous material layer, (iii) a luminous color converting layer containing a third color material, disposed between the first luminous material layer and second luminous material layer, and (iv) a color coat layer containing a fourth color material, disposed at the front surface side of the transparent substrate, in which the color material closer to the back electrode of the at least two elements has a color of longer wavelength than the remoter color material.

Preferably, the color of longer wavelength has a color of longer wavelength than the first luminous color emitted by the first luminous material.

Preferably, the first luminous material and second luminous material emit a same luminous color.

Preferably, the color of longer wavelength has a color of longer wavelength than the first luminous color emitted by the first luminous material, the first luminous material and second luminous material emit a same luminous color, the color of longer wavelength has a color of longer wavelength than the same luminous color.

Preferably, each color material of the first color material, second color material, third color material, and fourth color material contains at least one of fluorescent pigment and fluorescent dye.

Preferably, the transparent substrate is a transparent resin film, the first luminous material layer has a first transparent resin, the first luminous material layer is dispersed in the first transparent resin, the second luminous material layer has a second transparent resin, and the second luminous material layer is dispersed in the second transparent resin.

In this constitution, when a first color light having a first color is emitted from the first luminous material layer, a clear first color light is released from the luminous plane side without having effects of color materials contained in other layers. Further, when a second color light having a second color is emitted from the second luminous material layer, a clear third color light converted in color is released from the luminous plane side without having effects of color materials contained in other layers. As a result, a plurality of clear luminous colors are released from the luminous plane.

REFERENCE NUMERALS

Figure 1:
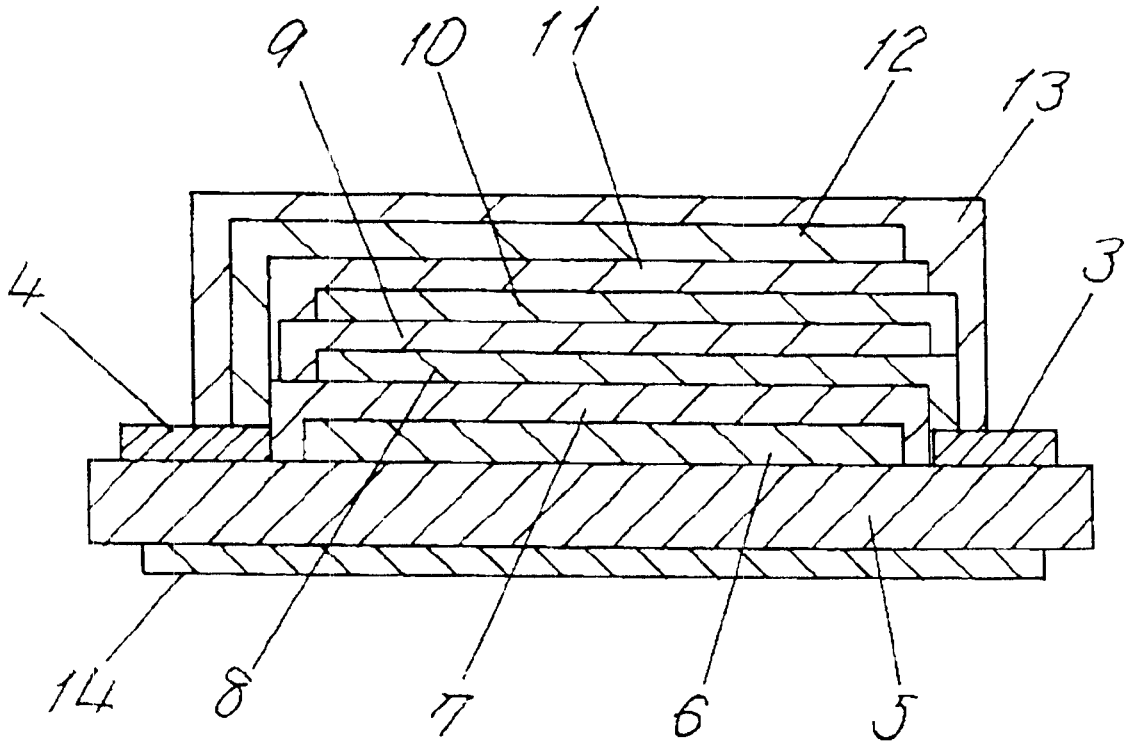
FIG. 1 is a sectional view of a multi-color emission-dispersion type EL lamp in an embodiment of the invention.

3, 4 External lead-out electrode
5 Transparent resin film
6 First light-permeable electrode layer
7, 15 First luminous material layer
8 Second light-permeable electrode layer (intermediate electrode layer)
9 Luminous color converting layer
10 Third light-permeable electrode layer (intermediate electrode layer)
11, 16 Second luminous material layer
12 Back electrode layer
13 Insulating protective layer
14 Color coat layer

DETAILED DESCRIPTION OF THE INVENTION

An electroluminescence lamp (EL lamp) in an embodiment of the invention comprises:

a transparent resin film as a transparent substrate, a first light-permeable electrode layer formed at the back side of the transparent resin film, a first luminous material layer disposed on the first light-permeable electrode layer, a second light-permeable electrode layer disposed on the first luminous material layer, a luminous color converting layer disposed on the second light-permeable electrode layer, a third light-permeable electrode layer disposed on the luminous color converting layer, a second luminous material layer disposed on the third light-permeable electrode layer, a back electrode layer disposed on the second luminous material layer, an insulating protective layer, and a color coat layer disposed on the front surface of the transparent resin film.

The first luminous material layer has a first resin and a first fluorescent material having a first luminous color dispersed in this first resin.

The luminous color converting layer has a third resin and a third color material dispersed in this third resin.

The second luminous material layer has a second resin and a second fluorescent material having a second luminous color dispersed in this second resin.

The third color material has a third color having longer wavelength than the first luminous color, and has a function of converting the second luminous color emitted from the second luminous material layer into a fourth color.

The color coat layer has a fourth resin, and a fourth color material dispersed in this fourth resin.

The fourth color material has a similar color to the first luminous color.

The third color material has a third fluorescent pigment or third fluorescent dye.

The fourth color material has a fourth fluorescent pigment or fourth fluorescent dye.

Each of the second light-permeable electrode layer and third light-permeable electrode layer is intermediate electrode layer.

In this constitution, when a first color light having a first color is emitted from the first luminous material layer, the first color light is reflected by the luminous light converting layer disposed at the back side of the first luminous material layer, and a reflected light is generated. This reflected light has a third color being converted to a longer wavelength side by the third color material. The reflected light having the third color is released from the front surface side of the, EL lamp through the color coat layer. When the reflected light passes through the color coat layer, the reflected light converted to the longer wavelength side is limited in passing by the fourth color material of a similar color to the first luminous color contained in the color coat layer, and hence the passing light is mainly the first color light. Thus, the first luminous color of the first luminous material layer is almost free from color interference, and the first color light emitted from the first luminous material layer is released from the front surface side of the EL lamp, having a first color closer to the original first luminous color.

When a second color light having a second color is emitted from the second luminous material layer, this second color light is converted into a fourth color having a longer wavelength than the first color light by the luminous color converting layer. This fourth color passes through the first luminous material layer and color coat layer, and is released from the EL lamp. When the fourth color light having the converted fourth color passes through the first luminous material layer and color coat layer, since the fourth color light has been converted to longer wavelength, the fourth color light converted to the longer wavelength does not develop the color of the first fluorescent material of the first luminous material layer or the fourth color material of the color coat layer, and although passing is slightly limited by the first luminous material layer and color coat layer, the fourth color light converted in color is released from the EL lamp.

In this constitution, when a first color light having a first color is emitted from the first luminous material layer, a clear first color light is released from the luminous plane side without having effects of color material contained in the luminous color converting layer. Further, when a second color light having a second color is emitted from the second luminous material layer, a clear fourth color light converted in color is released from the luminous plane side. As a result, color interference is prevented, and a plurality of clear luminous colors are released from the luminous plane.

The EL lamp in other embodiment of the invention comprises:

a first light-permeable electrode layer formed at the back side of a transparent resin film, a first luminous material layer formed on the first light-permeable electrode layer, a second light-permeable electrode layer disposed on the first luminous material layer, a luminous color converting layer disposed on the second light-permeable electrode layer, a third light-permeable electrode layer disposed on the luminous color converting layer, a second luminous material layer disposed on the third light-permeable electrode layer, a back electrode layer disposed on the second luminous material layer, and an insulating protective layer.

The first luminous material layer has a first resin, a first fluorescent material having a first luminous color dispersed in this first resin, and a first color material.

The second luminous material layer has a second resin and a second fluorescent material having a second luminous color dispersed in this second resin.

The luminous color converting layer has a third resin and a third color material dispersed in this third resin.

The first color material has a similar color to the first luminous color emitted from the first luminous material layer.

The third color material has a third color having longer wavelength than the first luminous color, and has a function of converting the second luminous color emitted from the second luminous material layer into a fourth color.

The third color material has a third fluorescent pigment or third fluorescent dye.

In this constitution, when a first color light having a first color is emitted from the first fluorescent material by applying an electricity to the first luminous material layer, the first color light is reflected by the luminous color converting layer disposed at the back side of the first luminous material layer, and a reflected light is generated. This reflected light has a third color being converted to a longer wavelength side by the third color material. The reflected light having the third color is released from the front surface side of the EL lamp through the first luminous material layer. When the reflected light passes through the first luminous material layer, the reflected light converted to the longer wavelength side is limited in passing by the first color material contained in the first luminous material layer, and hence the passing light is mainly the first color light. Thus, the first luminous color of the first luminous material layer is almost free from color interference, and the first color light emitted from the first luminous material layer is released from the front surface side of the EL lamp, having a first color closer to the original first luminous color.

When a second color light having a second color is emitted from the second luminous material layer, this second color light is converted into a fourth color having a longer wavelength than the first color light by the luminous color converting layer. This fourth color passes through the first luminous material layer, and is released from the EL lamp. When the fourth color light having the converted fourth color passes through the first luminous material layer, since the fourth color light has been converted to longer wavelength, the fourth color light converted to the longer wavelength does not develop the color of the first fluorescent material of the first luminous material layer or the like, and although passing is slightly limited by the first color material of the first luminous material layer, the fourth color light converted in color is released from the EL lamp.

In this constitution, when a first color light having a first color is emitted from the first luminous material layer, a clear first color light is released from the luminous plane side without having effects of color material contained in the luminous color converting layer. Further, when a second color light having a second color is emitted from the second luminous material layer, a clear fourth color light converted in color is released from the luminous plane side. As a result, color interference is prevented, and a plurality of clear luminous colors are released from the luminous plane.

The EL lamp in a different embodiment of the invention comprises:

- a first light-permeable electrode layer disposed at the back side of a transparent resin film,
- a first luminous material layer disposed on the first light-permeable electrode layer,
- a second light-permeable electrode layer disposed on the first luminous material layer,
- a second luminous material layer disposed on the second light-permeable electrode layer,
- a back electrode layer disposed on the second luminous material layer,
- an insulating protective layer, and
- a color coat layer disposed at the front surface side of the transparent resin film.

The first luminous material layer has a first resin, and a first fluorescent material having a first luminous color dispersed in this first resin.

The second luminous material layer has a second resin, a second fluorescent material having a second luminous color dispersed in this second resin, and a second color material.

The second color material has a third color having longer wavelength than the first luminous color, and has a function of converting the second luminous color generated from the second fluorescent material into a fourth color.

The second color material has a second fluorescent pigment or second fluorescent dye.

The color coat layer has a fourth resin, and a fourth color material dispersed in this fourth resin.

The fourth color material has a similar color to the first luminous color.

The fourth color material has a fourth fluorescent pigment or fourth fluorescent dye.

In this constitution, when a first color light having a first color is emitted from the first fluorescent material layer, the first color light is reflected by the second luminous material layer disposed at the back side of the first luminous material layer, and a reflected light is generated. This reflected light has a third color being converted to a longer wavelength side by the second color material. The reflected light having the third color is released from the front surface side of the EL lamp through the color coat layer. When the reflected light passes through the color coat layer, the reflected light converted to the longer wavelength side is limited in passing by the fourth color material of a similar color to the first luminous color contained in the color coat layer, and hence the passing light is mainly the first color light. Thus, the first luminous color of the first luminous material layer is almost free from color interference, and the first color light emitted from the first luminous material layer is released from the front surface side of the EL lamp, having a first color closer to the original first luminous color.

By applying an electricity in the second luminous material layer, a second color light having a second color is emitted from the second fluorescent material. This second color light is converted into a fourth color having a longer wavelength than the second color light by the second color material. This fourth color passes through the first luminous material layer and color coat layer, and is released from the EL lamp. When the fourth color light having the converted fourth color passes through the first luminous material layer and color coat layer, since the fourth color light has been converted to longer wavelength the fourth color light converted to the longer wavelength does not develop the color of the first fluorescent material of the first luminous material layer or the fourth color material of the color coat layer, and although passing is slightly limited by the first luminous material layer and the color coat layer, the fourth color light converted in color is released from the EL lamp.

In this constitution, when a first color light having a first color is emitted from the first luminous material layer, a clear first color light is released from the luminous plane side without having effects of color material contained in the second luminous material layer. Further, when a second color light having a second color is emitted from the second luminous material layer, a clear fourth color light converted in color is released from the luminous plane side. As a result, color interference is prevented, and a plurality of clear luminous colors are released from the luminous plane.

The EL lamp in a further different embodiment of the invention comprises:

- a first light-permeable electrode layer disposed at the back side of a transparent resin film,
- a first luminous material layer disposed on the first light-permeable electrode layer,
- a second light-permeable electrode layer disposed on the first luminous material layer,
- a second luminous material layer disposed on the second light-permeable electrode layer,
- a back electrode layer disposed on the second luminous material layer, and
- an insulating protective layer.

The first luminous material layer has a first resin, a first fluorescent material having a first luminous color dispersed in this first resin, and a first color material.

The first color material has a similar color to the first luminous color emitted from the first luminous material layer.

The first color material has a first fluorescent pigment or first fluorescent dye.

The second luminous material layer has a second resin, a second fluorescent material having a second luminous color dispersed in this second resin, and a second color material.

The second color material has a third color having longer wavelength than the first luminous color emitted from the first luminous material layer, and has a function of converting into a fourth color of longer wavelength than the second luminous color emitted from the second luminous material.

The second color material has a second fluorescent pigment or second fluorescent dye.

In this constitution, when a first color light having a first color is emitted from the first luminous material layer, the first color light is reflected by the second luminous material layer disposed at the back side of the first luminous material layer, and a reflected light is generated. This reflected light has a third color being converted to a longer wavelength side by the second color material. The reflected light having the third color is released from the front surface side of the EL lamp through the first luminous material layer. When the reflected light passes through the first luminous material layer, the reflected light converted to the longer wavelength side is limited in passing by the first color material contained in the first luminous material layer, and hence the passing light is mainly the first color light. Thus, the first luminous color of the first luminous material layer is almost free from color interference, and the first color light emitted from the first luminous material layer is released from the front surface side of the EL lamp, having a first color closer to the original first luminous color.

By applying an electricity in the second luminous material layer, a second color light having a second color is emitted from the second fluorescent material. This second color light is converted into a fourth color having a longer wavelength than the second color light by the second color material. This fourth color passes through the first luminous material layer, and is released from the EL lamp. When the fourth color light having the converted fourth color passes through the first luminous material layer, since the fourth color light has been converted to longer wavelength, the fourth color light converted to the longer wavelength does not develop the color of the first fluorescent material of the first luminous material layer or the like, and although passing is slightly limited by the first luminous material layer, the fourth color light converted in color is released from the EL lamp.

In this constitution, when a first color light having a first color is emitted from the first luminous material layer, a clear first color light is released from the luminous plane side without having effects of color material contained in the second luminous material layer. Further, when a second color light having a second color is emitted from the second luminous material layer, a clear fourth color light converted in color is released from the luminous plane side. As a result, color interference is prevented, and a plurality of clear luminous colors are released from the luminous plane.

In the embodiments, preferably, at least one luminous material layer of the first luminous material layer and second luminous material layer is formed of two layers. A first layer of the two layers is formed of a layer having a granular fluorescent material of a specified luminous color dispersed in a synthetic resin, or a layer having a granular fluorescent material and a fluorescent pigment or fluorescent dye of a specified luminous color dispersed in a synthetic resin. A second layer of the two layers is formed of a white insulating layer having a higher dielectric constant than the first layer, or an insulating layer containing fluorescent pigment or fluorescent dye.

The thickness of the first luminous material layer and second luminous material layer is increased, and hence the insulation between the light-permeable electrode layers in which a high voltage is applied is enhanced. It is controlled so that the dielectric constant may be relatively low in the portions in which the fluorescent materials in these luminous material layers are concentrated, and it is controlled so that the dielectric constant may be higher in other portions, so that it is possible to apply the voltage effectively to the fluorescent materials. As a result, the luminance at the time of emitting light can be enhanced.

In the embodiments, preferably, at least one electrode layer of the second light-permeable electrode layer and third light-permeable electrode layer is formed by printing and drying of the light-permeable conductive paste having a sheet resistance value of 50 KΩ or less containing conductive tin indium oxide and transparent synthetic resin.

In this constitution, when forming the second light-permeable electrode layer and third light-permeable electrode layer, the light-permeable conductive paste can be easily printed in a thick film in a desired pattern by screen printing or the like. At the same time, the multi-color emission-dispersion type EL lamp can be manufactured at a low cost. Further, the voltage can be uniformly applied to the luminous material layers, and uneven emission luminance can be suppressed.

Further, in the embodiments, preferably, the light-permeable conductive paste for forming at least one electrode layer of the second light-permeable electrode layer and third light-permeable electrode layer is colored and composed by the fluorescent pigment or fluorescent dye for converting the color into the longer wavelength than the first luminous color of the first luminous material layer.

In this constitution, the luminous color of the second luminous material layer can be converted in color more effectively.

The embodiments of the invention is described in detail below while referring to FIG. 1 to FIG. 4.

For the ease of understanding of the constitution, the drawing are shown in magnified dimensions in the thickness direction. Further, same constituent parts as explained in the prior art are identified with same reference numerals, and repeated description is omitted.

Exemplary Embodiment 1

FIG. 1 is a sectional view of a multi-color emission-dispersion type EL lamp in a first exemplary embodiment of the invention. In FIG. 1, the multi-color emission-dispersion type EL lamp comprises a transparent resin film 5, a first light-permeable electrode layer 6 disposed at a first plane side of the transparent resin film 5, a first luminous material layer 7 disposed on the first light-permeable electrode layer 6, a second light-permeable electrode layer 8 disposed on the first luminous material layer 7, a luminous color converting layer 9 disposed on the second light-permeable electrode layer 8, a third light-permeable electrode layer 10 disposed on the luminous color converting layer 9, a second luminous material layer 11 disposed on the third light-permeable electrode layer 10, a back electrode layer 12 disposed on the second luminous material layer 11, an insulating protective layer 13 disposed to cover the plurality of layers, a color coat layer 14 disposed on a second plane side of the transparent resin film 5, an external lead-out electrode 3 connected to the second light-permeable electrode layer 8 and third light-permeable electrode layer 10, and an external lead-out electrode 4 connected to the back electrode layer 12.

The second light-permeable electrode layer 8 and third light-permeable electrode layer 10 are intermediate electrode layers.

In this constitution, the first light-permeable electrode layer 6 contains indium oxide, and has a specified pattern shape. The first light-permeable electrode layer 6 is formed by screen printing and drying by using a light-permeable conductive paste. Such light-permeable conductive paste contains a resin material such as polyester resin, epoxy resin, acrylic resin, phenoxy resin, or fluororubber resin, and acicular powder of tin indium oxide dispersed in the resin material. The second light-permeable electrode layer 8 is similarly formed by using the same light-permeable conductive paste, and has a specified pattern shape. The third light-permeable electrode layer 10 is similarly formed by using the same light-permeable conductive paste, and has a specified pattern shape. The first light-permeable electrode layer 6 may be also composed to have a thin film formed by vacuum method of sputtering or vapor deposition. The second light-permeable electrode layer 8 and third light-permeable electrode layer 10 are preferred to have a sheet resistance value of 50 kΩ or less, respectively, and in this constitution, the voltage can be uniformly applied to the first luminous material layer 7 and second luminous material layer 11, so that uneven emission luminance can be suppressed.

The first luminous material layer 7 includes a first layer containing a first resin and a first fluorescent material dispersed in this first resin, and a second layer containing a first resin and a highly dielectric power dispersed in this first resin. The first fluorescent material has a powder shape. The second layer is overlaid on the first layer. The first fluorescent material has an EL fluorescent material of a first luminous color such as blue or green. The first resin is a resin having a high dielectric constant, and the resin having high dielectric constant contains cyanoethyl cellulose resin, cyanoethyl pullulan resin, vinylidene fluoride, or fluoro-rubber resin. The highly dielectric powder contains barium titanate or the like. The first layer is applied in a specified shape by the use of the paste containing such components, and dried and formed. The second layer is applied in a specified shape by the use of the paste containing such components, and dried and formed.

The second luminous material layer 11 includes a first layer containing a second resin and a second fluorescent material dispersed in this second resin, and a second layer containing a second resin and a highly dielectric power dispersed in this second resin. The second fluorescent material has a powder shape. The second layer is overlaid on the first layer. The second fluorescent material has an EL fluorescent material of a second luminous color such as blue or green. The second resin is a resin having a high dielectric constant, and the resin having high dielectric constant contains cyanoethyl cellulose resin, cyanoethyl pullulan resin, vinylidene fluoride, or fluoro-rubber resin. The highly dielectric powder contains barium titanate or the like. The first layer is applied in a specified shape by the use of the paste containing such components, and dried and formed. The second layer is applied in a specified shape by the use of the paste containing such components, and dried and formed. In this embodiment, the second fluorescent material is made of the same material as the first fluorescent material, but not limited to this, different materials may be used for the first fluorescent material and second fluorescent material. Similarly, the second resin is made of the same material as the first resin, but not limited to this, different materials may be used for the first resin and second resin.

The luminous color converting layer 9 contains a third resin and a third color material dispersed in the third resin. The third resin is a transparent resin. The transparent resin is, for example, acrylic resin, polyester resin, or epoxy resin. The third color material is fluorescent pigment or fluorescent dye of red, orange or yellow color. The luminous color converting layer 9 is formed in a specified shape by applying and drying the paste containing such components.

The back electrode layer 12 contains silver powder or carbon powder. The back electrode layer 12 is formed in a specified shape by the use of silver paste or carbon paste.

The external lead-out electrodes 3, 4 contain silver powder or carbon powder. The external lead-out electrodes 3, 4 are formed in a specified shape by the use of silver paste or carbon paste.

The insulating protective layer 13 has an electric insulating performance. The insulating protective layer 13 is formed by the use of paste containing polyester resin, urethane resin, or epoxy resin.

The color coat layer 14 contains a fourth resin and a fourth color material dispersed in this fourth resin. The fourth resin is a transparent resin. Examples of transparent resin include acrylic resin, polyester resin and epoxy resin, among others. The fourth color material contains fluorescent pigment or fluorescent dye of blue or green color similar to the first luminous color of the first fluorescent material contained in the first fluorescent material layer 7. The fourth resin in this embodiment is the same resin as the third resin used in the luminous color converting layer 9. However, the fourth resin may be also made of other resin than the third resin. The color coat layer 14 is formed in a specified shape by screen printing and drying by using the paste containing such components.

In the multi-color emission-dispersion type EL lamp formed in such process, when a first color light of blue or green color is emitted from the first luminous material layer 7, the first color light is reflected by the luminous color converting layer 9, and this reflected light has a third color converted to longer wavelength side by the third color material such as red, orange or yellow color of the luminous color converting layer 9. When the reflected light having the third color passes through the color coat layer 14, since its passing is limited by the fourth color material of similar color to the first luminous color contained in the color coat layer 14, the passing light is mainly the first color light. That is, the color interference by the blue or green color emitted from the first luminous material layer 7 is prevented. As a result, a color light of clear blue color or clear green color is released from the luminous plane side of the EL lamp.

On the other hand, when the second luminous material layer 11 is illuminated, the second luminous color is converted into a color light of longer wavelength than the tone of the first fluorescent material of, the first luminous material layer 7 and the color material of the color coat layer 14, by the third color material of red, orange or yellow color of the luminous color converting layer 9. The color light having the converted color has a longer wavelength, and hence does not develop the color of the first fluorescent material of the first luminous material layer 7 or the fourth color material of the color coat layer 14, and is only slightly limited in passing by the first fluorescent material of the first luminous material layer 7 or the color material of the color coat layer 14, and is released from the luminous plane side. Therefore, the color light emitted from the second luminous material layer 11 and converted in the luminous color converting layer 9 is free from color interference, and is released from the luminous plane side. As a result, a color light of clear red, clear orange or clear yellow color is released from the luminous plane side of the EL lamp.

Next, an EL lamp (sample S1) of the same constitution was fabricated, in which the luminous color of the first luminous material layer 7 is blue, the tone of the color coat layer 14 is blue, the tone of the luminous color converting layer 9 is red, and the luminous color of the second luminous material layer 11 is blue. Other EL lamp without color coat layer was also prepared (sample S2).

Using sample S1 and sample S2, the color coordinates of the first luminous material layer and second luminous material layer were measured in the case of disposing the translucent liquid crystal display device at the luminous plane side of the EL lamp, and in the case not disposing the translucent liquid crystal display device. The color coordinates were measured by using a Topcon color luminance meter. That is, in each sample, the color coordinates of the first luminous material layer 7 and second luminous material layer 11 were measured by illuminating the luminous material layer 7 and second luminous material layer 11. Results of measurement are summarized in Table 1. The numerical values in Table 1 denote x-values of color coordinates.

TABLE 1

| | | EL lamp without color coat layer (S2) | EL lamp with color coat layer (S1) |
|---|---|---|---|
| Without liquid crystal display device | First luminous material layer | 0.2798 | 0.2005 |
| | Second luminous material layer | 0.5345 | 0.5282 |
| With liquid crystal display device | First luminous material layer | 0.3002 | 0.2288 |
| | Second luminous material layer | 0.5547 | 0.5487 |

In Table 1, the degree of cool colors and warm colors is known from the x-values of the color coordinates. That is, as the x-value becomes smaller, the degree of cool colors is intensified. As the x-value becomes larger, the degree of warm colors is stronger.

Results in Table 1 disclose the following.

When the translucent liquid crystal display device is not disposed, the following facts are known.

The first luminous material layer of the EL lamp (S1) with color coat layer has an extremely smaller x-value than the EL lamp (S2) without color coat layer. In other words, the first luminous material layer of the EL lamp (S1) with color coat layer has an extremely strong cool color than the EL lamp (S2) without color coat layer. The second luminous material layer of the EL lamp (S1) with color coat layer has a slightly larger x-value than the EL lamp (S2) without color coat layer. But the difference of x-values is small. That is, in the warm color system of the second luminous material layer, the change of the luminous color x-values is small. Therefore, the difference between the x-value of luminous color emitted from the luminous plane by the first luminous material layer and the x-value of the luminous color emitted from the luminous plane by the second luminous material layer is extremely increased by the presence of the color coat layer. That is, the EL lamp having the color coat layer can obtain a plurality of clear luminous colors, as compared with the EL lamp without color coat layer.

When the translucent liquid crystal display device was disposed, similar results were obtained as in the case of not disposing the translucent liquid crystal display device mentioned above. That is, the first luminous material layer of the EL lamp (S1) with color coat layer has an extremely small x-value than the EL lamp (S2) without color coat layer. In the warm color system of the second luminous material layer, the change of the luminous color x-values is small. Therefore, the difference between the x-value of luminous color emitted from the luminous plane by the first luminous material layer and the x-value of the luminous color emitted from the luminous plane by the second luminous material layer is extremely increased by the presence of the color coat layer. That is, the EL lamp having the color coat layer can obtain a plurality of clear luminous colors, as compared with the EL lamp without color coat layer.

Thus, according to the constitution of the embodiment, color interference due to colored constituent materials such as third fluorescent color material is prevented, so that the multi-color emission-dispersion type EL lamp emitting a plurality of clear luminous colors may be obtained.

Exemplary Embodiment 2

Figure 2:
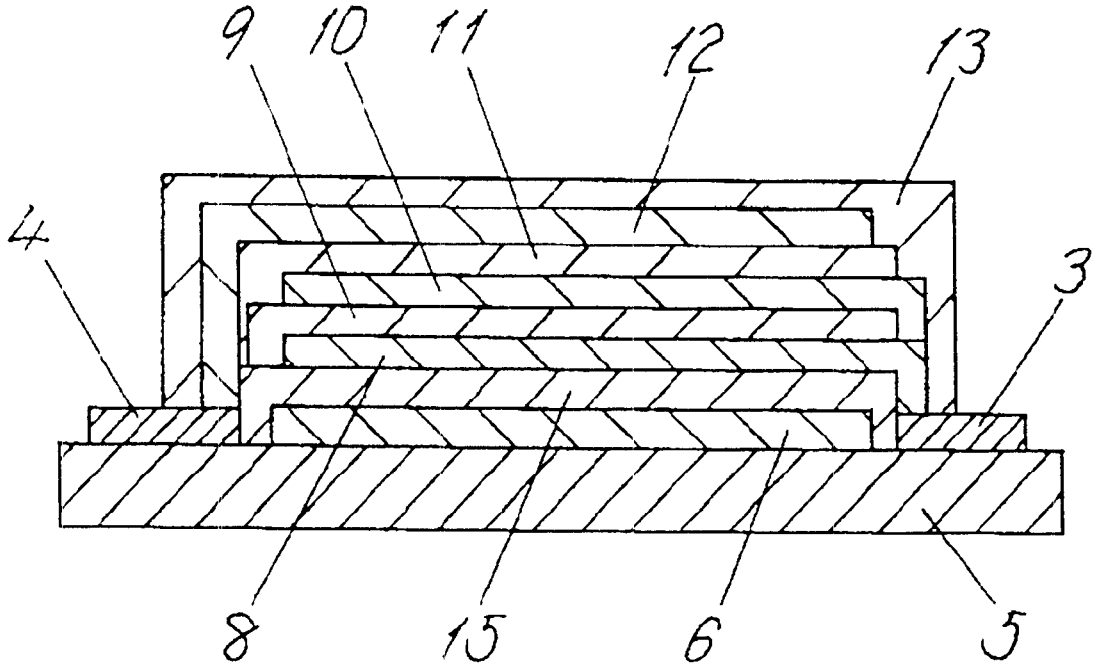
FIG. 2 is a sectional view of a multi-color emission-dispersion type EL lamp in other embodiment of the invention.

FIG. 2 is a sectional view of a multi-color emission-dispersion type EL lamp in a second exemplary embodiment of the invention. In FIG. 2, the multi-color emission-dispersion type EL lamp comprises a transparent resin film 5, a first light-permeable electrode layer 6 disposed at a first plane side of the transparent resin film 5, a first luminous material layer 15 disposed on the first light-permeable electrode layer 6, a second light-permeable electrode layer 8 disposed on the first luminous material layer 15, a luminous color converting layer 9 disposed on the second light-permeable electrode layer 8, a third light-permeable electrode layer 10 disposed on the luminous color converting layer 9, a second luminous material layer 11 disposed, on the third light-permeable electrode layer 10, a back electrode layer 12 disposed on the second luminous material layer 11, an insulating protective layer 13 disposed to cover the plurality of layers, an external lead-out electrode 3 connected to the second light-permeable electrode layer 8 and third light-permeable electrode layer 10, and an external lead-out electrode 4 connected to the back electrode layer 12.

The EL lamp of exemplary embodiment 2 does not include the color coat layer disposed in exemplary embodiment 1. Further, the first luminous material layer 15 has different components from those in the first luminous material in exemplary embodiment 1. In the EL lamp of exemplary embodiment 2, the layers except for the first luminous material layer 15 are composed of the same materials as in exemplary embodiment 1.

The first luminous material layer 15 includes a first layer, and a second layer overlaid on the first layer. The first layer contains a first resin, and a first fluorescent material and a first color material dispersed in this first resin. The second layer contains a first resin, and a highly dielectric powder dispersed in this first resin. The first fluorescent material has a powder shape. The first fluorescent material has an EL fluorescent material of a first luminous color such as blue or green. The first color material has at least one of fluorescent pigment and fluorescent dye. The first color material has a color similar to the first luminous color. The first resin is a resin having a high dielectric constant, and the resin having high dielectric constant contains cyanoethyl cellulose resin, cyanoethyl pullulan resin, vinylidene fluoride, or fluororubber resin. The highly dielectric powder contains barium titanate or the like. The first layer is applied in a specified shape by the use of the paste containing such components, and dried and formed. The second layer is applied in a specified shape by the use of the paste containing such components, and dried and formed.

In the multi-color emission-dispersion type EL lamp formed in such process, when the first luminous material layer 15 is illuminated, the first color light emitted in blue or green color by the first fluorescent material of the first luminous material layer 15 is reflected by the luminous color converting layer 9, and a reflected light is generated. This reflected light is converted to longer wavelength side by the third color material and has a third color. When the reflected light having the third color passes through the first luminous material layer 15, since its passing is limited by the first color material dispersed in the first luminous material layer 15, the passing light is mainly the first color light. That is, the first color light emitted from the first luminous material layer 15 is free from color interference by the luminous color converting layer 9, and is released from the luminous plane. As a result, a luminous color of clear blue color or clear green color is released from the luminous plane side of the EL lamp.

On the other hand, when the second luminous material layer 11 is illuminated, the second luminous color is converted into a color light of longer wavelength than the tone of the fluorescent material of the first luminous material layer 15, by the third color material of red, orange or yellow color of the luminous color converting layer 9. The color light converted in color passes through the luminous color converting layer 9 and first luminous material layer 15. The color light having the converted color has a longer wavelength, and hence does not develop the color of the first fluorescent material of the first luminous material layer 15, and is only slightly limited in passing by the third color material contained in the luminous color converting layer 9 and the first color material contained in the first luminous material layer 15, and is released from the luminous plane side. Therefore, when the second luminous material layer 11 is illuminated, the luminous color of clear red, clear orange or clear yellow color is released from the luminous plane side of the EL lamp.

Next, an EL lamp of the same constitution was fabricated, in which the luminous color of the first luminous material layer 15 is blue, the first fluorescent color material is a blue fluorescent pigment, the tone of the luminous color converting layer 9 is red, and the luminous color of the second luminous material layer 11 is blue. Other EL lamp was also prepared in which the first luminous material layer 15 does not contain the first fluorescent color material.

Using these samples, x-values of the color coordinates of the first luminous material layer 15 and second luminous material layer 11 were measured by using a Topcon color luminance meter, in the case of disposing the translucent liquid crystal display device at the luminous plane side of the EL lamp, and in the case not disposing the translucent liquid crystal display device, by illuminating the first luminous material layer 15 and second luminous material layer 11

Same as in exemplary embodiment 1, the measurement disclosed the following.

When the translucent liquid crystal display device is not disposed, there is a small difference in x-value between the second luminous material layer of the EL lamp having the first color material, and the EL lamp not containing the first color material. That is, the change is small in the luminous color x-value in the warm color system in the second luminous material layer. Therefore, the difference between the x-value of luminous color emitted from the luminous plane by the first luminous material layer and the x-value of the luminous color emitted from the luminous plane by the second luminous material layer is extremely increased by the presence of the first luminous material layer containing the first color material. That is, the EL lamp having the first luminous material layer with the first color material can obtain a plurality of clear luminous colors, as compared with the EL lamp without first color material.

When the translucent liquid crystal display device was disposed, similar results were obtained as in the case of not disposing the translucent liquid crystal display device mentioned above. That is, the EL lamp having the first luminous material layer with the first color material can obtain a plurality of clear luminous colors, as compared with the EL lamp without first color material.

Thus, according to the constitution of the embodiment, color interference due to colored constituent materials such as third color material contained in the luminous color converting layer is prevented, so that the multi-color emission-dispersion type EL lamp emitting a plurality of clear luminous colors may be obtained. Moreover, the manufacturing cost is saved as compared with the EL lamp having the color coat layer in exemplary embodiment 1.

Exemplary Embodiment 3

Figure 3:
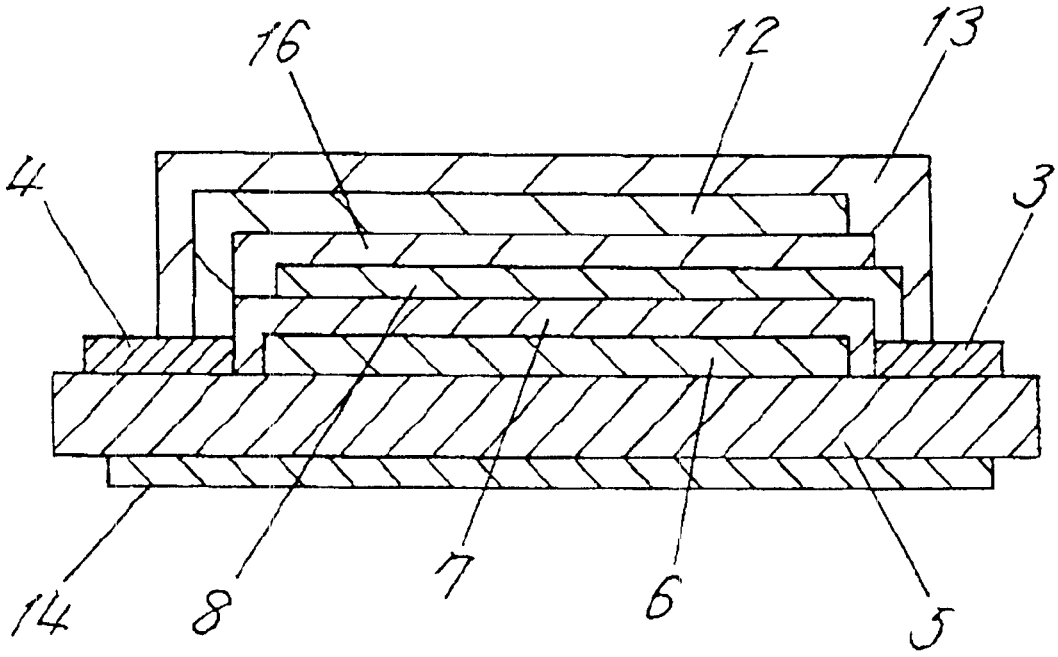
FIG. 3 is a sectional view of a multi-color emission-dispersion type EL lamp in a different embodiment of the invention.

FIG. 3 is a sectional view of a multi-color emission-dispersion type EL lamp in a third exemplary embodiment of the invention. In FIG. 3, the multi-color emission-dispersion type EL lamp comprises a transparent resin film 5, a first light-permeable electrode layer 6 disposed at a first plane side of the transparent resin film 5, a first luminous material layer 7 disposed on the first light-permeable electrode layer 6, a second light-permeable electrode layer 8 disposed on the first luminous material layer 7, a second luminous material layer 16 disposed on the second light-permeable electrode layer 8, a back electrode layer 12 disposed on the second luminous material layer 16, an insulating protective layer 13 disposed to cover the plurality of layers, a color coat layer 14 disposed on a second plane side of the transparent resin film 5, an external lead-out electrode 3 connected to the second light-permeable electrode layer 8 and third light-permeable electrode layer 10, and an external lead-out electrode 4 connected to the back electrode layer 12.

The EL lamp of exemplary embodiment 3 does not include the luminous color converting layer and third light-permeable electrode layer disposed in exemplary embodiment 1. Further, the second luminous material layer 16 has different components from those in the second luminous material in exemplary embodiment 1. In the EL lamp of exemplary embodiment 3, the layers except for the second luminous material layer 16 are composed of the same materials as in exemplary embodiment 1.

The second luminous material layer 16 includes a first layer, and a second layer overlaid on the first layer. The first layer contains a second resin, and a second fluorescent material and a second color material dispersed in this second resin. The second layer contains a second resin, and a highly dielectric powder dispersed in this second resin. The second fluorescent material has a powder shape. The second fluorescent material has an EL fluorescent material of a second luminous color such as blue or green. The second color material has at least one of fluorescent pigment and fluorescent dye. The second color material has a color such as red, orange or yellow color of longer wavelength than the luminous light of the second fluorescent material. The second resin is a resin having a high dielectric constant, and the resin having high dielectric constant contains cyanoethyl cellulose resin, cyanoethyl pullulan resin, vinylidene fluoride, or fluoro-rubber resin. The highly dielectric powder contains barium titanate or the like. The first layer is applied in a specified shape by the use of the paste containing such components, and dried and formed. The second layer is applied in a specified shape by the use of the paste containing such components, and dried and formed.

In the multi-color emission-dispersion type EL lamp formed in such process, when the first luminous material layer 7 is illuminated, the first fluorescent material of the first luminous material layer 7 emits a first color of blue or green color. The first color light emitted from the first luminous material layer 7 is reflected by the second luminous material layer 16, and a reflected light is reflected. This reflected light is converted to a third color light of longer wavelength by the second color material contained in the second luminous material layer 16. The third color is limited in passing by a fourth fluorescent color material of similar color to the first luminous color dispersed in the color coat layer 14, and the passing light is mainly the first color light. That is, the first color light emitted from the first luminous material layer 7 is free from color interference by the second color material contained in the second luminous material layer 16, and is released from the luminous plane side. As a result, a luminous color of clear blue color or clear green color is released from the luminous plane side of the EL lamp.

On the other hand, when a voltage is applied to the second luminous material layer 16, the second fluorescent material contained in the second luminous material layer 16 emits a second color light. This second color light is converted into a color light of longer wavelength than the tone of the first fluorescent material of the first luminous material layer 7 and the fourth fluorescent color material of the color coat layer 14, by the second color material of red, orange or yellow color dispersed in the second luminous material layer 16. The color light having the converted color has a longer wavelength, and hence does not develop the color of the first fluorescent material of the first luminous material layer 7 or the fourth fluorescent color material of the color coat layer 14, and is only slightly limited in passing by the color material of the color coat layer 14 or the like, and is released from the luminous plane side. Therefore, the luminous color of clear red, clear orange or clear yellow color is released from the luminous plane side.

Next, an EL lamp of the same constitution was fabricated, in which the luminous color of the first luminous material layer 7 is blue, the luminous color of the second luminous material layer 16 is blue, the second color material is red fluorescent pigment, and the fourth color material of the color coat layer 14 is blue. Other EL lamp was also prepared in which the second luminous material layer 16 does not contain the second color material.

Using these samples, x-values of the color coordinates of the first luminous material layer 7 and second luminous material layer 16 were measured by using a Topcon color luminance meter, in the case of disposing the translucent liquid crystal display device at the luminous plane side of the EL lamp, and in the case not disposing the translucent liquid crystal display device, by illuminating the first luminous material layer 7 and second luminous material layer 16.

The measurement disclosed the following results.

When the translucent liquid crystal display device was not disposed, the following was known. There is a small difference in x-value between the first luminous material layer of the EL lamp having the second color material, and the first luminous material layer of the EL lamp not containing the second color material. That is, the change is small in the luminous color x-value in the cool color system in the second luminous material layer. Therefore, the difference between the x-value of luminous color emitted from the luminous plane by the first luminous material layer and the x-value of the luminous color emitted from the luminous plane by the second luminous material layer is extremely increased by the presence of the second luminous material layer containing the second color material. That is, the EL lamp having the second luminous material layer with the second color material can obtain a plurality of clear luminous colors, as compared with the EL lamp without second color material.

When the translucent liquid crystal display device was disposed, similar results were obtained as in the case of not disposing the translucent liquid crystal display device mentioned above. That is, the EL lamp having the second luminous material layer with the second fluorescent color material can obtain a plurality of clear luminous colors, as compared with the EL lamp without second fluorescent color material.

Thus, according to the constitution of the embodiment, the multi-color emission-dispersion type EL lamp emitting a plurality of clear luminous colors is obtained. Moreover, the manufacturing cost is saved as compared with the EL lamp having the luminous color converting layer and third light-permeable electrode layer in exemplary embodiment 1.

Exemplary Embodiment 4

Figure 4:
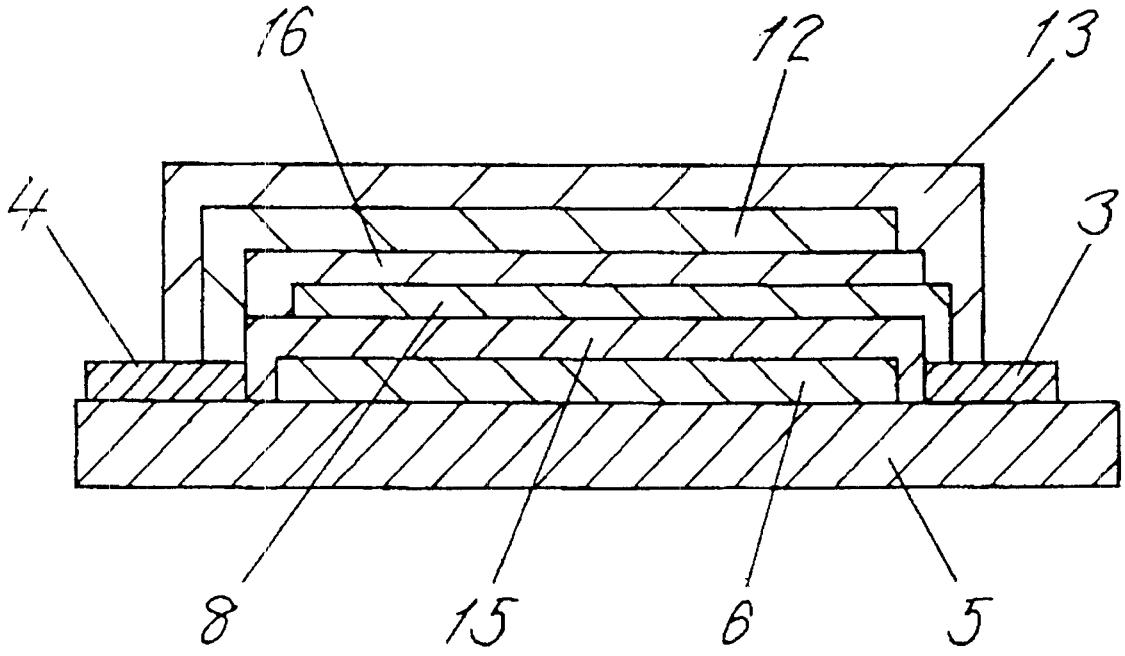
FIG. 4 is a sectional view of a multi-color emission-dispersion type EL lamp in a further different embodiment of the invention.
Figure 5:
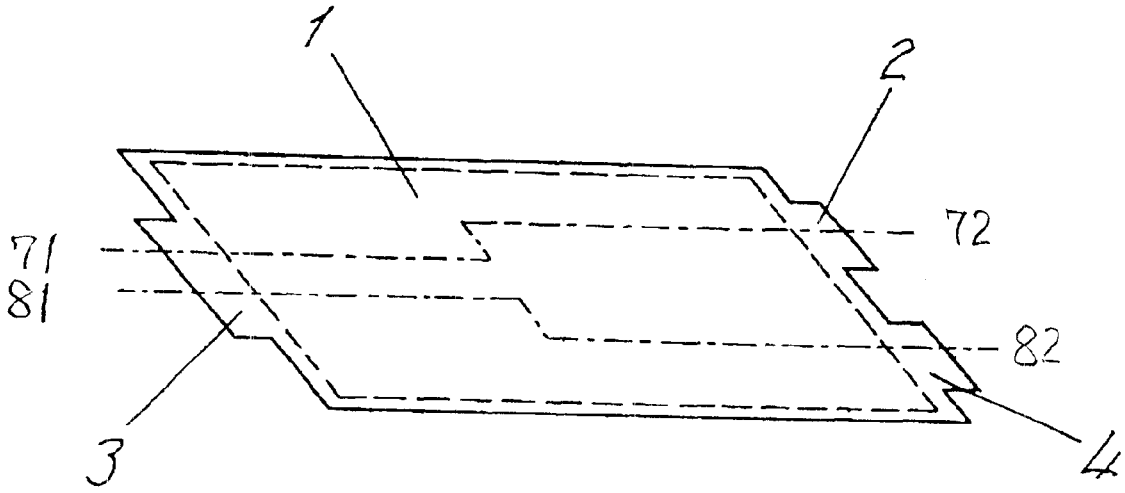
Fig. 5 PRIOR ART
FIG. 5 is an outline perspective view of a conventional multi-color emission-dispersion type EL lamp.
Figure 6:
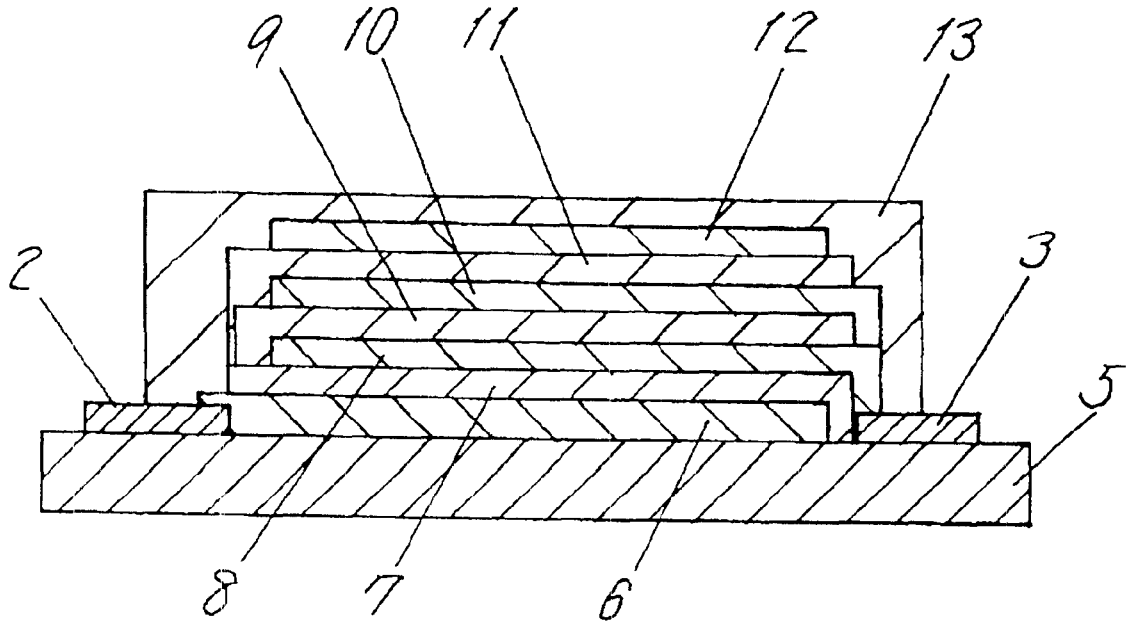
Fig. 6 PRIOR ART
FIG. 6 is a sectional view along line 71–72 in FIG. 5.
Figure 7:
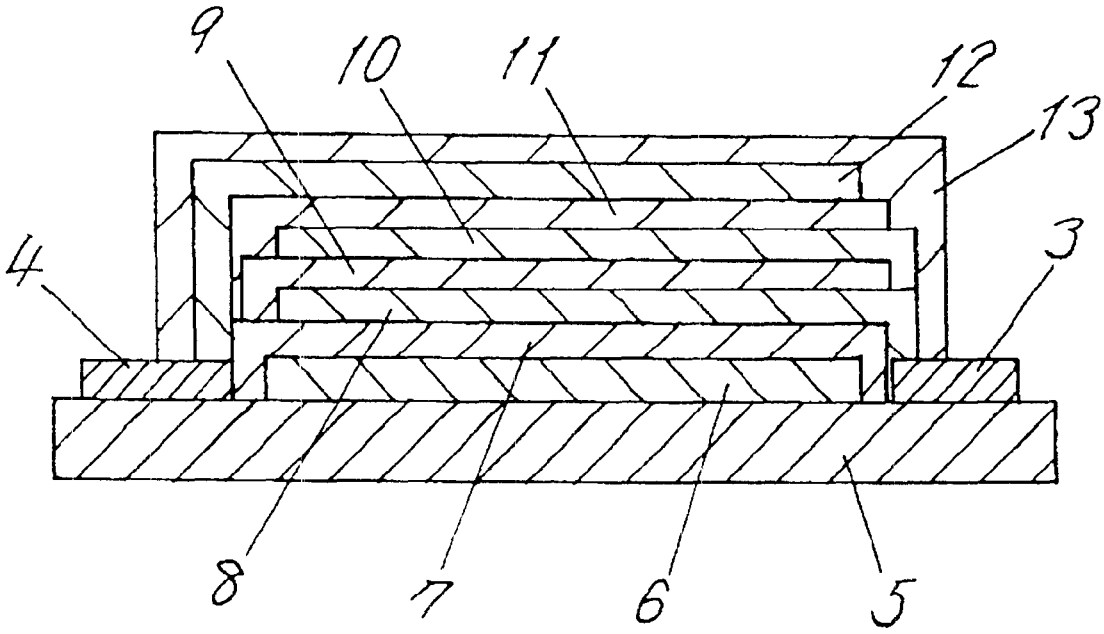
Fig. 7 PRIOR ART
FIG. 7 is a sectional view along line 81–82 in FIG. 5.

FIG. 4 is a sectional view of a multi-color emission-dispersion type EL lamp in a fourth exemplary embodiment of the invention. In FIG. 4, the multi-color emission-dispersion type EL lamp comprises a transparent resin film 5, a first light-permeable electrode layer 6 disposed at a first plane side of the transparent resin film 5, a first luminous material layer 15 disposed on the first light-permeable electrode layer 6, a second light-permeable electrode layer 8 disposed on the first luminous material layer 15, a second luminous material layer 16 disposed on the second light-permeable electrode layer 8, a back electrode layer 12 disposed on the second luminous material layer 16, an insulating protective layer 13 disposed to cover the plurality of layers, an external lead-out electrode 3 connected to the second light-permeable electrode layer 8 and third light-permeable electrode layer 10, and an external lead-out electrode 4 connected to the back electrode layer 12.

The EL lamp of exemplary embodiment 4 does not include the luminous color converting layer, third light-permeable electrode layer and color coat layer disposed in exemplary embodiment 1. Also, the first luminous material layer 15 has different components from those in the first luminous material in exemplary embodiment 1. Further, the second luminous material layer 16 has different components from those in the second luminous material in exemplary embodiment 1. In the EL lamp of exemplary embodiment 4, the layers except for the first luminous material layer 15 and second luminous material layer 16 are composed of the same materials as in exemplary embodiment 1.

The first luminous material layer 15 has the same constitution and is made of the same materials as the first luminous material layer 15 explained in the foregoing exemplary embodiment 2. That is, the first luminous material layer 15 has a first luminous material and a first color material.

The second luminous material layer 16 has the same constitution and is made of the same materials as the second luminous material layer 16 explained in the foregoing exemplary embodiment 3. That is, the second luminous material layer 16 has a second luminous material and a second color material.

The other layers except for the first luminous material layer 15 and second luminous material layer 16 are composed of the same materials as in exemplary embodiment 1.

In the multi-color emission-dispersion type EL lamp formed in such process, when the first luminous material layer 15 is illuminated, the first fluorescent material of the first luminous material layer 15 emits a first color of blue or green color. The first color light is reflected by the second luminous material layer 16, and is converted to a third color light of longer wavelength by the second color material contained in the second luminous material layer 16. As the reflected light converted in color is released, its passing is limited by the first color material dispersed in the first luminous material layer 15, and the passing light is mainly the first color light, which is released from the luminous plane side. That is, the first color light emitted from the first luminous material layer is released from the luminous plane side without having light interference by the second color material contained in the second luminous material layer. As a result, a luminous color of clear blue color or clear green color is released from the luminous plane side.

On the other hand, when the second luminous material layer 16 is illuminated, its luminous color is converted into a luminous color of longer wavelength than the tone of the first color material of the first luminous material layer 15 or the like, by the second color material of red, orange or yellow color dispersed in the second luminous material layer 16. The color light having the converted color has a longer wavelength, and hence does not develop the color of the first fluorescent material of the first luminous material layer 15, and is only slightly limited in passing by the first color material contained in the first luminous material layer 15, and is released from the luminous plane side. Therefore, the luminous color of clear red, clear orange or clear yellow color is released from the luminous plane side.

Next, an EL lamp of the same constitution was fabricated, in which the luminous color of the fluorescent material of the first luminous material layer 15 and the first fluorescent color material is blue, the luminous color of the second luminous material layer 16 is blue, and the second color material is red fluorescent pigment. Other EL lamp was also prepared in which the first luminous material layer 15 does not contain the first color material and the second luminous material layer 16 does not contain the second color material.

Using these samples, x-values of the color coordinates of the first luminous material layer 7 and second luminous material layer 16 were measured by using a Topcon color luminance meter, in the case of disposing the translucent liquid crystal display device at the luminous plane side of the EL lamp, and in the case not disposing the translucent liquid crystal display device, by illuminating the first luminous material layer 7 and second luminous material layer 16.

As a result, the EL lamp having the first luminous material layer with the first color material and the second luminous material layer with the second color material had a greater difference in the tone between the cool color system and the warm color system, than the EL lamp having the first luminous material layer without first color material and the second luminous material layer without second color material In the constitution of the embodiment, therefore, the multi-color emission-dispersion type EL lamp capable of emitting a plurality of clear luminous colors was obtained. Further, the manufacturing cost is saved as compared with the EL lamp having the luminous color converting layer, third light-permeable electrode layer, and color coat layer in exemplary embodiment 1.

Still more, by coloring the light-permeable conductive paste used in the second light-permeable electrode layer by the fluorescent pigment or fluorescent dye for converting into color of longer wavelength than the luminous color of the first luminous material layer 15, the luminous color of the second luminous material layer 16 may be more effectively converted in color, and the difference in the tone between the cool color system and the warm color system may be further increased when the first luminous material layer 15 and second luminous material layer 16 are illuminated separately.

Thus, according to the invention, when the first color light having the first color is emitted from the first luminous material layer, it is free from effects of color materials contained in other layers, and a clear first color light is released from the luminous plane side. Further, when the second color light having the second color is emitted from the second luminous material layer, it is free from effects of color materials contained in other layers, and a clear color light converted in color is released from the luminous plane side. As a result, a plurality of clear luminous colors can be released from the luminous plane.

What is claimed is:

1. An EL lamp for emitting light in multiple colors, comprising:

a transparent resin film, a first light-permeable electrode layer formed at the back side of said transparent resin film, a first luminous material layer disposed above said first light-permeable electrode layer, a second light-permeable electrode layer disposed above said first luminous material layer, a luminous color converting layer disposed above said second light-permeable electrode layer, a third light-permeable electrode layer disposed above said luminous color converting layer, a second luminous material layer disposed above said third light-permeable electrode layer, a back electrode layer disposed above said second luminous material layer, and a color coat layer disposed above the front surface of said transparent resin film, wherein said first luminous material layer has a first resin and a first fluorescent material having a first luminous color dispersed in said first resin, said luminous color converting layer has a third resin and a third color material dispersed in said third resin, said second luminous material layer has a second resin and a second fluorescent material having a second luminous color dispersed in said second resin, said third color material has a third color having longer wavelength than said first luminous color, and has a function of converting the second luminous color emitted from said second luminous layer into a fourth color, said color coat layer has a fourth resin, and a fourth color material dispersed in said fourth resin, said fourth color material has a similar color to said first luminous color, said third color material has at least one of a third fluorescent pigment and third fluorescent dye, and said fourth color material has at least one of a fourth fluorescent pigment and fourth fluorescent dye.

2. The EL lamp of claim 1, wherein at least one of said first luminous material layer and second luminous material layer has two layers of a first layer and a second layer, said first layer has said first luminous material dispersed in said first resin, said second layer has said first resin and a highly dielectric material, and said second layer has a higher dielectric constant than said first layer.

3. The EL lamp of claim 1, wherein at least one of said second light-permeable electrode layer and third light-permeable electrode layer contains a transparent resin and conductive powder of tin indium oxide dispersed in said transparent resin, and has a sheet resistance value of 50 kΩ or less.

4. The EL lamp of claim 1, wherein at least one of said second light-permeable electrode layer and third light-permeable electrode layer has a color colored by at least one of a fluorescent pigment and fluorescent dye for converting color into a longer wavelength than said first luminous color of said first luminous material layer.

5. An EL lamp for emitting light in multiple colors, comprising:

a transparent resin film having a front surface and a back side, a first light-permeable electrode layer formed at said back side of said transparent resin film, a first luminous material layer disposed above said first light-permeable electrode layer, a second light-permeable electrode layer disposed above said first luminous material layer, a luminous color converting layer disposed above said second light-permeable electrode layer, a third light-permeable electrode layer disposed above said luminous color converting layer, a second luminous material layer disposed above said third light-permeable electrode layer, and a back electrode layer disposed above said second luminous material layer, wherein said first luminous material layer has a first resin, a first fluorescent material having a first luminous color dispersed in said first resin, and a first color material, said second luminous material layer has a second resin and a second fluorescent material having a second luminous color dispersed in said second resin, said luminous color converting layer has a third resin and a third color material dispersed in said third resin, said first color material has a same color as a first luminous color emitted from said first luminous material layer, said third color material has a third color having longer wavelength than said first luminous color, and has a function of converting a second luminous color emitted from said second luminous material layer into a fourth color, and said third color material has at least one of a third fluorescent pigment and third fluorescent dye.

6. The EL lamp of claim 5, wherein at least one of said first luminous material layer and second luminous material layer has two layers of a first layer and a second layer, said first layer of said first luminous material layer has said first luminous material dispersed in said first resin and said first color material, said second layer has said first resin and highly dielectric material, and said second layer has a higher dielectric constant than said first layer.

7. The EL lamp of claim 5, wherein at least one of said second light-permeable electrode layer and third light-permeable electrode layer contains a transparent resin and conductive powder of tin indium oxide dispersed in said transparent resin, and has a sheet resistance value of 50 kΩ or less.

8. The EL lamp of claim 5, wherein at least one of said second light-permeable electrode layer and third light-permeable electrode layer has a color colored by at least one of a fluorescent pigment and fluorescent dye for converting color into a longer wavelength than said first luminous color of said first luminous material layer.

9. An EL lamp for emitting light in multiple colors, comprising:

a transparent resin film, a first light-permeable electrode layer formed at the back side of said transparent resin film, a first luminous material layer disposed on said first light-permeable electrode layer, a second light-permeable electrode layer disposed on said first luminous material layer, a second luminous material layer disposed on said second light-permeable electrode layer, a back electrode layer disposed on said second luminous material layer, and a color coat layer disposed on the front surface side of said transparent resin film, wherein said first luminous material layer has a first resin and a first fluorescent material having a first luminous color dispersed in said first resin, said second luminous material layer has a second resin, a second fluorescent material having a second luminous color dispersed in said second resin, and a second color material, said second color material has a third color having longer wavelength than said first luminous color, and has a function of converting a second luminous color emitted from said second fluorescent material into a fourth color, said second color material has at least one of a second fluorescent pigment and second fluorescent dye, said color coat layer has a fourth resin, and a fourth color material dispersed in said fourth resin, said fourth color material has a similar color to said first luminous color, and said fourth color material has at least one of a fourth fluorescent pigment and fourth fluorescent dye.

10. The EL lamp of claim 9, wherein at least one of said first luminous material layer and second luminous material layer has two layers of a first layer and a second layer, said first layer of said second luminous material layer has said first luminous material dispersed in said first resin, and said second color material, said second layer has said first resin and a highly dielectric material, and said second layer has a higher dielectric constant than said first layer.

11. The EL lamp of claim 9, wherein said second light-permeable electrode layer contains a transparent resin and conductive powder of tin indium oxide dispersed in said transparent resin, and has a sheet resistance value of 50 kΩ or less.

12. The EL lamp of claim 9, wherein said second light-permeable electrode layer has a color colored by at least one of a fluorescent pigment and fluorescent dye for converting color into a longer wavelength than said first luminous color of said first luminous material layer.

13. An EL lamp for emitting light in multiple colors, comprising:

a transparent resin film, a first light-permeable electrode layer formed at a back side of said transparent resin film, a first phosphor powder layer disposed on said first light-permeable electrode layer, a second light-permeable electrode layer disposed on said first phosphor powder layer, a second phosphor powder layer disposed on said second light-permeable electrode layer, a back electrode layer disposed on said second phosphor powder layer, and an insulating protective layer, wherein said first phosphor powder layer has a first resin, a first phosphor powder having a first luminous color disposed in said first resin, and a first color material, said first color material has a same color as the first luminous color emitted from said first phosphor powder layer, said first color material having at least one of a first fluorescent pigment and a first fluorescent dye, said second phosphor powder layer has a second resin, a second phosphor powder having a second luminous color dispersed in said second resin, and a second color material, said second color material has a third color of a longer wavelength than the first luminous color emitted from said first phosphor powder layer, said second color material having a function of converting into a fourth color having a longer wavelength than the second luminous color emitted from said second phosphor powder, said second color material having at least one of a second fluorescent pigment and second fluorescent dye.

14. The EL lamp according to claim 13, wherein said pigment and said dye of the first phosphor powder layer reduce the reflecting light from the second phosphor powder layer.

15. An EL lamp for emitting light in multiple colors from a front surface side of a transparent substrate, comprising:

(a) said transparent substrate, (b) a first light-permeable electrode layer formed at a back side of said transparent substrate, (c) a first luminous material layer having a first luminous material having a first luminous color, disposed at a back side of said first light-permeable electrode layer, (d) an intermediate light-permeable electrode layer disposed at a back side of said first luminous material layer, (e) a second luminous material layer having a second luminous material, disposed at a back side of said intermediate light-permeable electrode layer, (f) a back electrode layer disposed at a back side of said second luminous material layer, and (g) a color coat layer containing a color material disposed at the front surface side of said transparent substrate, wherein said transparent substrate is a transparent resin film, said first luminous material layer has a first transparent resin, said first luminous material is disposed in said first transparent resin, said second luminous material layer has a second transparent resin, and said second luminous material is disposed in said second transparent resin.

16. An EL lamp for emitting light in multiple colors from a front surface side of a transparent substrate, comprising:

(a) said transparent substrate, (b) a first light-permeable electrode layer formed at a back side of said transparent substrate, (c) a first luminous material layer having a first luminous material, disposed at a back side of said first light-permeable electrode layer, (d) an intermediate light-permeable electrode layer disposed at a back side of said first luminous material layer, (e) a second luminous material layer having a second luminous material, disposed at a back side of said intermediate light-permeable electrode layer, (f) a back electrode layer disposed at a back side of said second luminous material layer, and (g) a color coat layer containing a color material disposed at the front surface side of said transparent substrate, wherein at least one of said first luminous material layer and said second luminous material layer has two layers, of a first layer and a second layer, said first layer having said first luminous material dispersed in a resin, said second layer having said resin and a highly dielectric material, and said second layer having a higher dielectric constant than said first layer.

17. An EL lamp for emitting light in multiple colors from a front surface side of a transparent substrate, comprising:

(a) said transparent substrate, (b) a first light-permeable electrode layer formed at a back side of said transparent substrate, (c) a first luminous material layer having a first luminous material, disposed at a backside of said first light-permeable electrode layer, (d) an intermediate light-permeable electrode layer disposed at a back side of said first luminous material layer, (e) a second luminous material layer having a second luminous material, disposed at a back side of said intermediate light-permeable electrode layer, (f) a back electrode layer disposed at a back side of said second luminous material layer, and (g) a color coat layer containing a color material disposed at the front surface side of said transparent substrate, wherein said intermediate light-permeable electrode layer contains a transparent resin and a conductive powder of tin indium oxide disposed in said transparent resin, and has a sheet resistance value of 50 KΩ or less.

18. An EL lamp for emitting light in multiple colors from a front surface side of a transparent substrate, comprising:

(a) said transparent substrate, (b) a first light-permeable electrode layer formed at a back side of said transparent substrate, (c) a first luminous material layer having a first luminous material, disposed at a back side of said first light-permeable electrode layer, (d) an intermediate light-permeable electrode layer disposed at a back side of said first luminous material layer, (e) a second luminous material layer having a second luminous material, disposed at a back side of said intermediate light-permeable electrode layer, (f) a back electrode layer disposed at a back side of said second luminous material layer, and (g) a color coat layer containing a color material disposed at the front surface side of said transparent substrate, wherein at least one of said first luminous material layer and second luminous material layer has two layers, of a first layer and a second layer, said first layer having at least one of said first luminous material and said second luminous material dispersed in a resin, said second layer having said first resin and a highly dielectric material, and said second layer having a higher dielectric constant than said first layer.

19. An EL lamp for emitting light in multiple colors, comprising:

a transparent resin film, a first light-permeable electrode layer formed at the back side of said transparent resin film, a first luminous material layer disposed on said first light-permeable electrode layer, a second light-permeable electrode layer disposed on said first luminous material layer, a second luminous material layer disposed on said second light-permeable electrode layer, a back electrode layer disposed on said second luminous material layer, and an insulating protective layer, wherein said first luminous material layer has a first resin, a first fluorescent material having a first luminous color dispersed in said first resin, and a first color material, said first color material has a same color as the first luminous color emitted from said first luminous material layer, said first color material has at least one of a first fluorescent pigment and first fluorescent dye, said second luminous material layer has a second resin, a second fluorescent material having a second luminous color dispersed in said second resin, and a second color material, said second color material has a third color of longer wavelength than the first luminous color emitted from said first luminous material layer, and has a function of converting into a fourth color having longer wavelength than the second luminous color emitted from said second luminous material, and said second color material has at least one of a second fluorescent pigment and second fluorescent dye wherein at least one of said first luminous material layer and second luminous material layer has two layers of a first layer and a second layer, said first layer has said first luminous material dispersed in said first resin and said second color material, said second layer has said first resin and a highly dielectric material; and said second layer has a higher dielectric constant than said first layer.

20. An EL lamp for emitting light in multiple colors, comprising:

a transparent resin film, a first light-permeable electrode layer formed at the back side of said transparent resin film, a first luminous material layer disposed on said first light-permeable electrode layer, a second light-permeable electrode layer disposed on said first luminous material layer, a second luminous material layer disposed on said second light-permeable electrode layer, a back electrode layer disposed on said second luminous material layer, and an insulating protective layer, wherein said first luminous material layer has a first resin, a first fluorescent material having a first luminous color dispersed in said first resin, and a first color material, said first color material has a same color as the first luminous color emitted from said first luminous material layer, said first color material has at least one of a first fluorescent pigment and first fluorescent dye, said second luminous material layer has a second resin, a second fluorescent material having a second luminous color dispersed in said second resin, and a second color material, said second color material has a third color of longer wavelength than the first luminous color emitted from said first luminous material layer, and has a function of converting into a fourth color having longer wavelength than the second luminous color emitted from said second luminous material, and said second color material has at least one of a second fluorescent pigment and second fluorescent dye, and wherein said second light-permeable electrode layer contains a transparent resin and conductive powder of tin indium oxide dispersed in said transparent resin, and has a sheet resistance value of 50 kΩ or less.

21. An EL lamp for emitting light in multiple colors, comprising:

a transparent resin film, a first light-permeable electrode layer formed at the back side of said transparent resin film, a first luminous material layer disposed on said first light-permeable electrode layer, a second light-permeable electrode layer disposed on said first luminous material layer, a second luminous material layer disposed on said second light-permeable electrode layer, a back electrode layer disposed on said second luminous material layer, and an insulating protective layer, wherein said first luminous material layer has a first resin, a first fluorescent material having a first luminous color dispersed in said first resin, and a first color material, said first color material has a same color as the first luminous color emitted from said first luminous material layer, said first color material has at least one of a first fluorescent pigment and first fluorescent dye, said second luminous material layer has a second resin, a second fluorescent material having a second luminous color dispersed in said second resin, and a second color material, said second color material has a third color of longer wavelength than the first luminous color emitted from said first luminous material layer, and has a function of converting into a fourth color having longer wavelength than the second luminous color emitted from said second luminous material, and said second color material has at least one of a second fluorescent pigment and second fluorescent dye, and wherein said second light-permeable electrode layer has a color colored by at least one of a fluorescent pigment and fluorescent dye for converting color into a longer wavelength than said first luminous color of said first luminous material layer.

22. An EL lamp for emitting light in multiple colors from a front surface side of a transparent substrate, comprising:

(a) said transparent substrate, (b) a first light-permeable electrode layer formed at a back side of said transparent substrate, (c) a first luminous material layer having a first luminous material, disposed at a back side of said first light-permeable electrode layer, (d) an intermediate light-permeable electrode layer disposed at a back side of said first luminous material layer, (e) a second luminous material layer having a second luminous material, disposed at a back side of said intermediate light-permeable electrode layer, (f) a back electrode layer disposed at a back side of said second luminous material layer, (g) a first color material contained in said first luminous material layer, (h) a second color material contained in said second luminous material layer, (i) a luminous color converting layer containing a third color material, disposed between said first luminous material layer and said second luminous material layer, and (j) a color coat layer containing a fourth color material disposed at the front surface side of said transparent substrate, wherein at least one of said first luminous material layer and said second luminous material layer has two layers, of a first layer and a second layer, said first layer has said first luminous material dispersed in said first resin, said second layer has said first resin and a highly dielectric material, and said second layer has a higher dielectric constant than said first layer.

23. An EL lamp for emitting light in multiple colors from a front surface side of a transparent substrate, comprising:

(a) said transparent substrate, (b) a first light-permeable electrode layer formed at a back side of said transparent substrate, (c) a first luminous material layer having a first luminous material, disposed at a back side of said first light-permeable electrode layer, (d) an intermediate light-permeable electrode layer disposed at a back side of said first luminous material layer, (e) a second luminous material layer having a second luminous material, disposed at a back side of said intermediate light-permeable electrode layer, (f) a back electrode layer disposed at a back side of said second luminous material layer, (g) a first color material contained in said first luminous material layer, (h) a second color material contained in said second luminous material layer, (i) a luminous color converting layer containing a third color material, disposed between said first luminous material layer and said second luminous material layer, and (j) a color coat layer containing a fourth color material disposed at the front surface side of said transparent substrate, wherein said intermediate light-permeable electrode layer contains a transparent resin and a conductive powder of tin indium oxide disposed in said transparent resin, and has a sheet resistance value of 50 KΩ or less.

24. An EL lamp for emitting light in multiple colors from a front surface side of a transparent substrate, comprising:

(a) said transparent substrate, (b) a first light-permeable electrode layer formed at a back side of said transparent substrate, (c) a first luminous material layer having a first luminous material, disposed at a back side of said first light-permeable electrode layer, (d) an intermediate light-permeable electrode layer disposed at a back side of said first luminous material layer, (e) a second luminous material layer having a second luminous material, disposed at a back side of said intermediate light-permeable electrode layer, (f) a back electrode layer disposed at a back side of said second luminous material layer, (g) a first color material contained in said first luminous material layer, and (h) a luminous color converting layer containing a second color material, disposed between said first luminous material layer and said second luminous material layer, wherein at least one of said first luminous material layer and said second luminous material layer has two layers, of a first layer and a second layer, said first layer has said first luminous material dispersed in said first resin, said second layer has said first resin and a highly dielectric material, and said second layer has a higher dielectric constant than said first layer.

25. An EL lamp for emitting light in multiple colors from a front surface side of a transparent substrate, comprising:

(a) said transparent substrate, (b) a first light-permeable electrode layer formed at a back side of said transparent substrate, (c) a first luminous material layer having a first luminous material, disposed at a back side of said first light-permeable electrode layer, (d) an intermediate light-permeable electrode layer disposed at a back side of said first luminous material layer, (e) a second luminous material layer having a second luminous material, disposed at a back side of said intermediate light-permeable electrode layer, (f) a back electrode layer disposed at a back side of said second luminous material layer, (g) a first color material contained in said first luminous material layer, and (h) a luminous color converting layer containing a second color material, disposed between said first luminous material layer and said second luminous material layer, wherein said intermediate light-permeable electrode layer contains a transparent resin and a conductive powder of tin indium oxide disposed in said transparent resin, and has a sheet resistance value of 50 KΩ or less.

26. An EL lamp for emitting light in multiple color from a front surface side of a transparent substrate, comprising:

(a) said transparent substrate, (b) a first light-permeable electrode layer formed at a back side of said transparent substrate, (c) a first luminous material layer having a first luminous material, disposed at a back side of said first light-permeable electrode layer, (d) an intermediate light-permeable electrode layer disposed at a back side of said first luminous material layer, (e) a second luminous material layer having a second luminous material, disposed at a back side of said intermediate light-permeable electrode layer, (f) a back electrode layer disposed at a back side of said second luminous material layer, (g) a first color material contained in said second luminous material layer, and (h) a color coat layer containing a second color material disposed at the front surface side of said transparent substrate, wherein at least one of said first luminous material layer and said second luminous material layer has two layers, of a first layer and a second layer, said first layer has said first luminous material dispersed in said first resin, said second layer has said first resin and a highly dielectric material, and said second layer has a higher dielectric constant than said first layer.

27. An EL lamp for emitting light in multiple color from a front surface side of a transparent substrate, comprising:

(a) said transparent substrate, (b) a first light-permeable electrode layer formed at a back side of said transparent substrate, (c) a first luminous material layer having a first luminous material, disposed at a back side of said first light-permeable electrode layer, (d) an intermediate light-permeable electrode layer disposed at a back side of said first luminous material layer, (e) a second luminous material layer having a second luminous material, disposed at a back side of said intermediate light-permeable electrode layer, (f) a back electrode layer disposed at a back side of said second luminous material layer, (g) a first color material contained in said second luminous material layer, and (h) a color coat layer containing a second color material disposed at the front surface side of said transparent substrate, wherein said intermediate light-permeable electrode layer contains a transparent resin and a conductive powder of tin indium oxide disposed in said transparent resin, and has a sheet resistance value of 50 KΩ or less.

28. An EL lamp for emitting light in multiple colors from a front surface side of a transparent substrate, comprising:

(a) said transparent substrate, (b) a first light-permeable electrode layer formed at a back side of said transparent substrate, (c) a first luminous material layer having a first luminous material, disposed at a back side of said first light-permeable electrode layer, (d) an intermediate light-permeable electrode layer disposed at a back side of said first luminous material layer, (e) a second luminous material layer having a second luminous material, disposed at a back side of said intermediate light-permeable electrode layer, (f) a back electrode layer disposed at a back side of said second luminous material layer, (g) a first color material contained in said first luminous material layer, and (h) a second color material contained in said second luminous material layer, wherein at least one of said first luminous material layer and said second luminous material layer has two layers, of a first layer and a second layer, said first layer has said first luminous material dispersed in said first resin, said second layer has said first resin and a highly dielectric material, and said second layer has a higher dielectric constant than said first layer.

29. An EL lamp for emitting light in multiple colors from a front surface side of a transparent substrate, comprising:

(a) said transparent substrate, (b) a first light-permeable electrode layer formed at a back side of said transparent substrate, (c) a first luminous material layer having a first luminous material, disposed at a back side of said first light-permeable electrode layer, (d) an intermediate light-permeable electrode layer disposed at a back side of said first luminous material layer, (e) a second luminous material layer having a second luminous material, disposed at a back side of said intermediate light-permeable electrode layer, (f) a back electrode layer disposed at a back side of said second luminous material layer, (g) a first color material contained in said first luminous material layer, and (h) a second color material contained in said second luminous material layer, wherein said intermediate light-permeable electrode layer contains a transparent resin and conductive powder of tin indium oxide disposed in said transparent resin, and has a sheet resistance value of 50 KΩ or less.

* * * * *